US007278899B2

(12) United States Patent
Davis

(10) Patent No.: US 7,278,899 B2
(45) Date of Patent: Oct. 9, 2007

(54) ADHESIVE ENHANCING SUPPORT BRA

(75) Inventor: Theodore L. Davis, Becket, MA (US)

(73) Assignee: Brazabra Corporation, Lee, MA (US)

( * ) Notice: Subject to any disclaimer, the term of this patent is extended or adjusted under 35 U.S.C. 154(b) by 76 days.

(21) Appl. No.: 11/144,577

(22) Filed: Jun. 3, 2005

(65) Prior Publication Data

US 2006/0276104 A1 Dec. 7, 2006

(51) Int. Cl.
*A41C 3/12* (2006.01)
*A41C 3/14* (2006.01)

(52) U.S. Cl. ..... 450/81; 450/38; 450/54

(58) Field of Classification Search ..... 450/36–38, 450/54–58; 2/267, 268; 623/7, 8
See application file for complete search history.

(56) References Cited

U.S. PATENT DOCUMENTS 2,079,426 A 5/1937 Schottenfels
3,401,407 A * 9/1968 Pittman ..... 623/7
5,693,164 A * 12/1997 Chang ..... 156/152
5,755,611 A * 5/1998 Noble et al. ..... 450/39
5,922,023 A * 7/1999 Mulligan et al. ..... 623/7
6,036,577 A * 3/2000 Coburn ..... 450/57
6,371,831 B1 * 4/2002 Dodge ..... 450/81
D485,965 S 2/2004 Slimak et al.
6,761,614 B2 * 7/2004 Pinna ..... 450/81
6,780,081 B2 8/2004 Chen et al.
6,852,001 B2 2/2005 Chen et al.
6,857,932 B2 * 2/2005 Chen ..... 450/38
6,916,224 B2 7/2005 Chen et al.

OTHER PUBLICATIONS

Bragel-Products NuBra, <www.bragel.com/products/nubra.php>.

* cited by examiner

*Primary Examiner*—Gloria M. Hale
(74) *Attorney, Agent, or Firm*—Cowan, Liebowitz & Latman, P.C.

(57) ABSTRACT

An adhesive bra element comprising a support member having an outer surface and an inner surface, and comprising at least one of a foam and a gel, an adhesive layer disposed over a substantial area of the inner surface of the support member, wherein the bra element includes a shaped cup portion and an upper extension portion extending from an upper end of the cup portion.

32 Claims, 2 Drawing Sheets

ADHESIVE ENHANCING SUPPORT BRA

BACKGROUND OF THE INVENTION

This invention relates to an adhesive bra and, in particular, to an adhesive bra that provides support and enhancement for a user's breasts.

It is desirable in the selection of undergarments to have a bra which provides both support and enhancement to the shape of the user's breasts. It is also desirable to have a bra which would not become obviously visible when the user wears revealing or low-cut clothing.

Adhesive bras are known in the art and are particularly useful for wearing with strapless and/or backless garments. An example of an adhesive bra is disclosed in a commonly-assigned U.S. Pat. No. D485,965. The '965 patent shows an adhesive bra including two bra elements, each element having an elongated narrow top portion and an enlarged bottom portion when viewed from the front or the back, and being planar in shape with a relatively uniform thickness throughout, when viewed from the top, bottom or side.

Each bra element of the adhesive bra of the '965 patent can be used to support a user's breast by adhering the enlarged bottom portion to the breast itself, and then pulling upward and adhering the elongated top portion to the user's body above the breast. In this way, the breast is pulled upward and held to provide the desired support. The thin uniform configuration of the bra element, however, does not enhance the size or shape appearance of the user's breast.

Other types of bra elements for providing such enhancement are known such as, for example, breast forms or bra cups which use materials such as foam or silicone gel to realize enhanced breast size and shape. U.S. Pat. No. 6,780,081 discloses a backless, strapless adhesive bra for enhancing a user's breasts having two breast cups each made from a plurality of layers including two fabric layers with foam material disposed there between and an interior thermoplastic film layer adjoined to one of the fabric layers. In the '081 patent the bra cups of the bra are joined with one another by a connector which may be adjusted so as to enhance breast cleavage of the user. This patent also teaches the use of a pull-up device attached to the lateral end of the top edge of each bra cup. The pull-up device is attachable to the user's skin by an adhesive so as to realize push up enhancement for the user's breast.

Another bra which uses breast forms and a connector therebetween is described in U.S. Pat. No. 6,758,720. In this patent, one form of the breast forms uses a silicone material encased by a thermoplastic film material and having an adhesive layer on the interior surface of the breast form. U.S. Pat. No. 6,857,932 also discloses this type of breast form in which a fabric layer is placed over the thermoplastic film layers.

While the adhesive bras of the aforesaid patents enhance the shape of the user's breasts and create cleavage, these bras typically lack sufficient support for the user's breasts. In particular, these bras are worn by adhering the bra cups or forms on top of the user's breasts so that the breasts act as a "shelf" to support the bra elements and by adjusting the connector to create cleavage and squeezing action to help secure the cups to the user's body. Because proper use of these silicone or foam bras requires that the breasts provide the support for the bra elements, such bras cannot be used by women with flaccid or pancake-shaped breasts. Moreover, because these bras require the use of a center connector between the bra elements, the bras cannot be used with garments that have a deep-plunging neckline without revealing the bra connector.

It is, therefore, an object of the present invention to provide an adhesive bra that provides support for the user's breasts while enhancing the shape of the user's breasts.

It is a further object of the present invention to provide an adhesive bra which provides sufficient support to and reshapes flaccid breasts.

It is yet another object of the present invention to provide an adhesive bra which does not require a connector and does not become visible when worn under garments with deep plunging necklines.

SUMMARY OF THE INVENTION

In accordance with the principles of the present invention, the above and other objectives are realized in an adhesive bra element comprising a support member having an outer surface and an inner surface and comprising at least one of a foam or a gel, and an adhesive layer disposed over at least a substantial area of the inner surface of the support member. The bra element is formed as a shaped cup portion and an upper extension portion extending from the upper end of the cup portion, with the adhesive layer disposed on both the cup portion and the upper extension. The upper extension portion may extend substantially in an upward direction from at least a central area of the cup portion. It may further extend from substantially the entire length of the edge of the upper end of the cup portion and may be continuous with the cup portion. The cup portion has a rounded concave shape adapted to receive a user's breast, and the upper portion is adapted to adhere to the user's chest wall and is one of substantially planar and having a slight curvature adapted to the shape of the user's chest wall. The bra element may have a teardrop shape.

In the embodiment to be disclosed hereafter, the support member of the adhesive bra element comprises silicone gel, and in particular, the support member comprises a plurality of layers, with a first layer and a second layer comprising thermoplastic film such as polyurethane film, and a third layer comprising molded silicone gel, and the third layer being disposed between the first and second layers. The first and second layers may be laminated to opposing surfaces of the third layer such that the first layer forms the outer surface of the support member and the second layer forms the inner surface. The thickness of the third layer may be varied such that its thickness in the cup portion decreases toward the outer periphery of the cup portion and the overall thickness of the third layer in the cup portion is greater than the thickness of the third layer in the upper extension of portion of the bra element. Moreover, the thickness of the third layer in the cup portion of the bra element may be adjusted so as to increase a user's bust size.

Also, in the disclosed embodiment, the adhesive layer comprises a pressure-sensitive re-usable adhesive and may be disposed over an entire area of the inner surface of the support member. The bra element may further include a backing layer, which may be formed from coated paper, affixed to at least a portion of the adhesive layer. In the embodiment shown, the backing layer is affixed to the adhesive layer of the upper extension portion.

An adhesive support bra including a first adhesive element and a second adhesive element is also described.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE INVENTION

Figure 1:
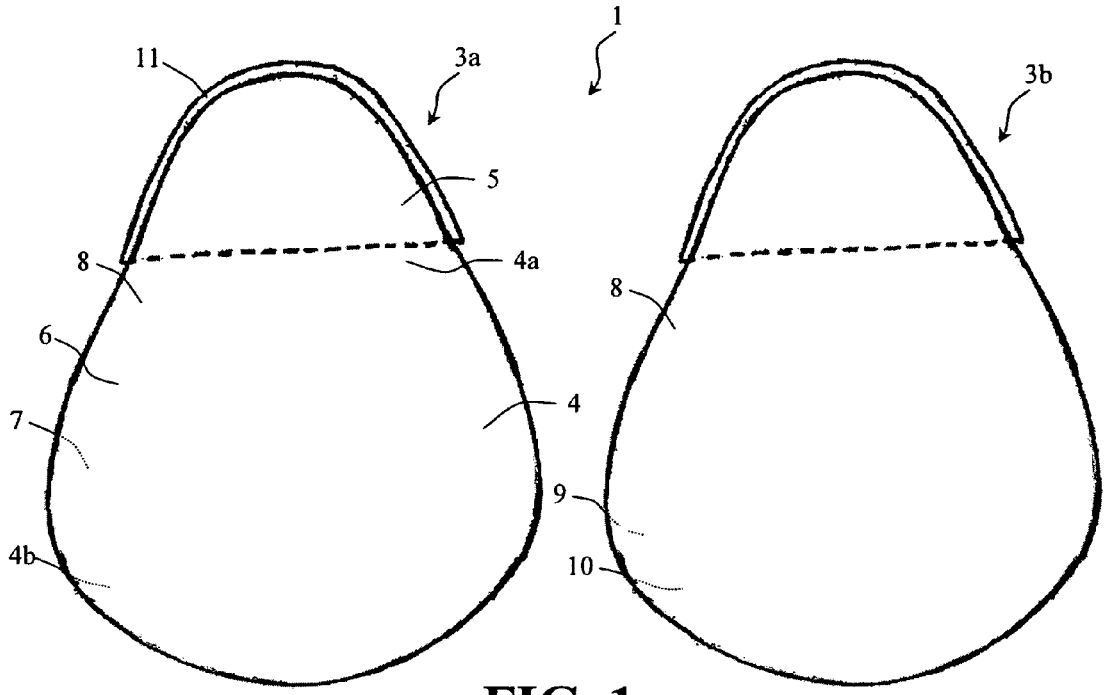
FIG. 1 shows a front view of the adhesive support bra in accordance with the present invention.
Figure 2:
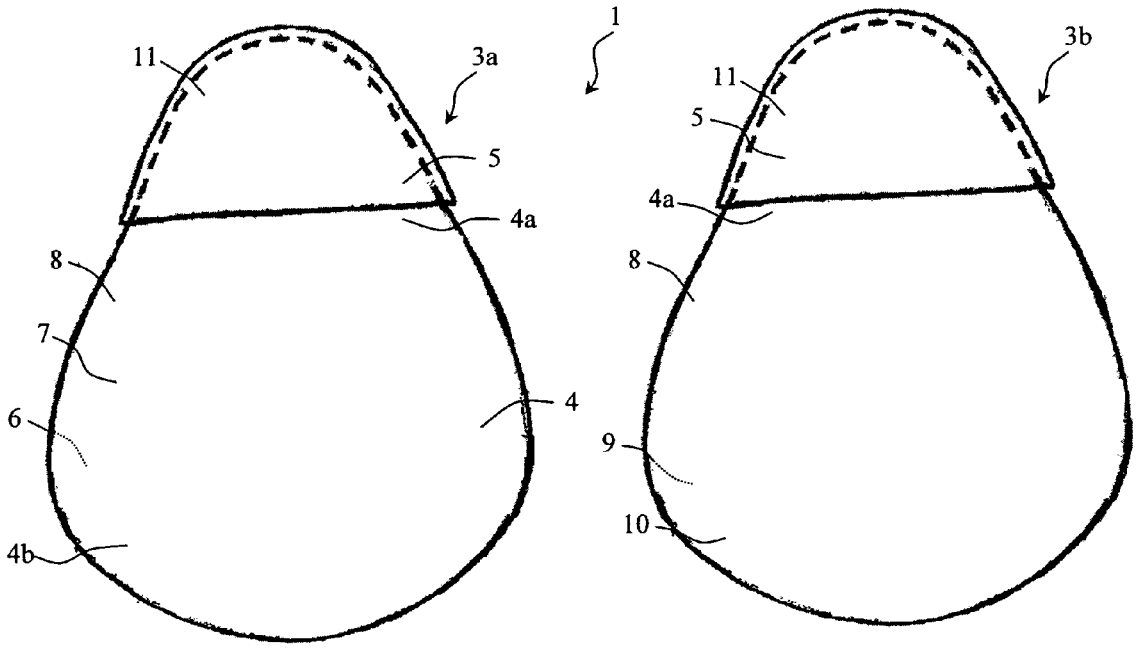
FIG. 2 shows a back view of the adhesive support bra of FIG. 1.
Figure 3:
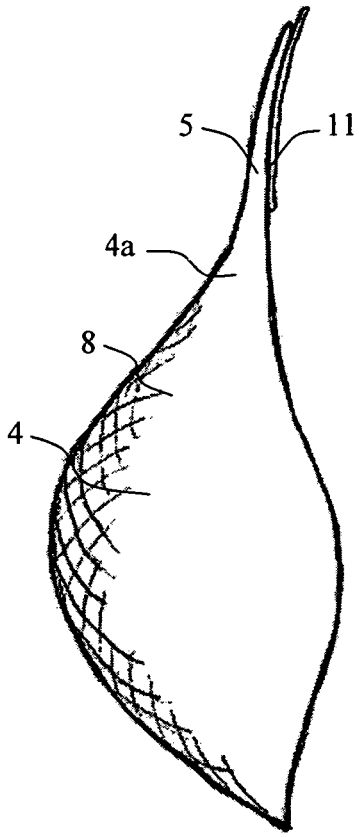
FIG. 3 shows a side view of a bra cup of the adhesive support bra of FIG. 1.
Figure 4:
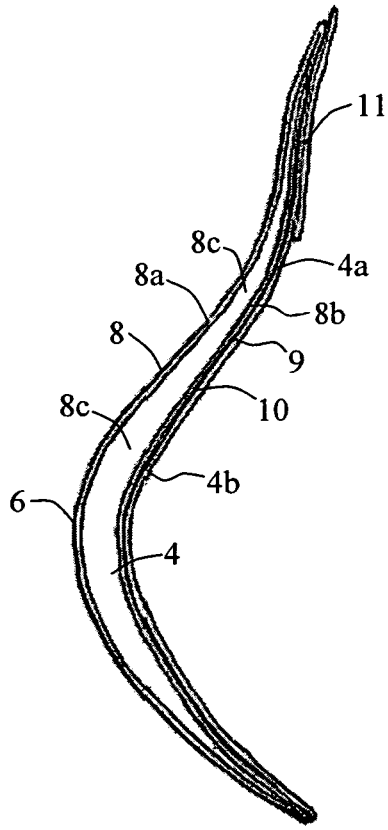
FIG. 4 shows a cross-sectional view of the bra cup of FIG. 3.

FIGS. 1-4 show an adhesive support bra 1 in accordance with the principles of the present invention. FIGS. 1 and 2 show a front view and a back view, respectively, of the bra 1 in an unworn state. FIG. 3 shows a side view of one bra cup of the adhesive support bra 1 of FIGS. 1 and 2 and FIG. 4 shows a cross-sectional view of the bra cup of FIG. 3.

As shown in FIGS. 1 and 2, the bra 1 includes first and second bra elements to be used as a right bra cup 3*a* and a left bra cup 3*b*, which are symmetrical. As shown, the cups 3*a*, 3*b* are not connected to one another, allowing the user to apply each cup 3*a*, 3*b* individually and to adjust the application of each cup 3*a*, 3*b* according to the user's needs and breast shape. In this form, the bra 1 has no center connector, nor any straps, and is a backless-strapless type bra.

As can be seen in FIGS. 1 and 2, each bra cup 3*a*, 3*b* has a front surface 6 and a back surface 7. The front surface 6 is shown in more detail in FIG. 1, and the back surface 7, which is the surface facing the user's breast, is shown in FIG. 2.

Each cup 3*a*, 3*b* of the bra 1 comprises a support member 8 having one surface forming the front surface 6 of the bra 1 and an opposing or inner surface 9, and an adhesive layer 10. The support member 8 comprises a foam or silicone material, as described in more detail herein below. The adhesive layer 10 is disposed on the opposing or inside surface 9 of the support member 8. In this illustrative embodiment, the adhesive layer 10 covers substantially the entire extent of the surface 9. The adhesive layer 10 is formed from a pressure-sensitive adhesive which can be re-used and cleaned from debris using mild soap, such as mild bar or liquid soap, in warm water.

As shown in FIGS. 1, 2 and 3, the bra cups 3*a*, 3*b* have a shape adapted to provide support as well as enhancement to the user's breasts. In particular, each bra cup 3*a*, 3*b* includes a rounded cup portion 4 shaped such that the user's breast can be placed inside the cup portion 4, which can then act as a shelf for supporting the breast. Each cup 3*a*, 3*b* also includes an upper extension 5 for anchoring to the chest wall below the clavicle or collar bone of the user. The upper extension 5 extends from the edge of the upper end 4*a* of the cup portion 4 and, in particular, extends outwardly in an upward direction from at least a central portion of the upper end 4*a*. In this way, when the bra 1 is worn by the user and the user pulls the upper extension 5 in an upward direction, the force exerted on the cup portion 4, which is supporting the breast, is directed upward, without causing any significant lateral shifting of the cup portion 4. In addition, in the present illustrative embodiment, the upper extension 5 extends from substantially the entire length of the edge of the upper end 4*a* of the cup portion 4 so as to provide sufficient support to the user's breast when the upper extension 5 is pulled upwards.

As can be seen in FIG. 3, while the cup portion 4 has a rounded shape adapted to enclose the user's breast, the upper extension 5 is substantially planar or has a slight curvature adapted to the shape of the user's chest wall. In the illustrative embodiment shown, the upper extension 5 forms a substantially flat flap portion that extends from the upper end 4*a* of the cup portion 4. The upper extension 5 of the cup 3*a*, 3*b* is preferably formed from the same material as the cup portion 4 and is continuous with the cup portion 4. In the case shown, the sides of the upper extension taper inwardly and terminate in a rounded top edge so as to give each of the bra cups 3*a*, 3*b* an elongated or teardrop shape, which can be used with revealing and low-cut garments.

The rounded or curved shape of the cup portion 4 provides enhancement to the shape of the user's breast. In particular, the cup portion 4 forms a concave surface 4*b*, which corresponds to the back surface 7 of the bra cup 3*a*, 3*b* and, as illustratively shown in FIGS. 1-3, is formed by the adhesive layer 10 disposed on the corresponding inner surface 9 of the support member 8. In this way, as above-mentioned, the user's breast can be placed inside the cup portion 4 and the adhesive layer 10 adheres to the user's skin. The outer convex-shaped surface 4*c* of the cup portion 4, which corresponds to the front surface 6 of the cup 3*a*, 3*b*, defines the shape of the user's breast when the cup 3*a*, 3*b* is worn by the user. The cup portion 4 may also be used to increase the size of the user's breasts by increasing the thickness of the support member 8 in the cup portion 4 area.

In addition to providing enhancement to the shape of the user's breasts, the arrangement of the cup portion 4 together with the upper extension 5, as shown in FIGS. 1-3, also provides support for the user's breasts. In particular, after the user's breast is placed inside the cup portion 4 which houses or acts as a shelf for and adheres to the user's breast via the adhesive layer 10 thereon, the upper extension 5 can be pulled by the user in an upward direction and adhered at a desired location on the user's chest wall so as to raise the user's breast. The adhering of the upper extension 5 to the chest wall of the user above the user's breast via the adhesive 10 assists in supporting the user's breast, so that the bra cup is not merely supported by the user's breast as in the prior bra elements discussed above.

In the preferred embodiment, the adhesive layer 10 forms the entire back surface 7 of the upper extension 5 so that the adhering strength of the upper extension 5 to the user's chest wall and therefore the support provided to the user's breast is maximized. Moreover, where, as illustratively shown in FIGS. 1-3, the upper extension 5 is continuous or integral with the cup portion 4, the risks of disengagement of the upper extension 5 from the cup portion 4 and of shifting of the upper extension 5 with respect to the user's chest wall or with respect to the cup portion 4 are significantly reduced or eliminated. The continuous and integrated arrangement of the cup portion 4 together with the upper extension 5 thus also improves the support to the user's breasts provided by the bra 1.

As also shown in FIGS. 1-3, each bra cup 3*a*, 3*b* also includes a backing layer 11, which is releasably affixed to the adhesive layer 10 of the bra 1. In the illustrative example shown, a portion of the adhesive layer 10 disposed on the surface 9 of the support member 8 is covered by the backing layer 11. The adhesive of the adhesive layer 10 holds the backing layer 11 in place until it is removed by the user. As can be appreciated, the backing layer 11 acts to protect the adhesive layer 10 from dirt and drying out. When using the respective bra cup 3*a*, 3*b*, the user removes the backing layer 11 by separating, or peeling off, the backing layer 11 from the support member 8 and the adhesive layer 10. When the backing layer 11 is peeled off, the adhesive layer 10 remains on the opposing surface 9 of the support member 8 so that the cup 3*a*, 3*b* can be applied and adhere to the user's skin.

In the illustrative embodiment shown in FIGS. 1-3, the backing layer 11 covers a portion of the adhesive layer 10, and in particular, the adhesive layer 10 of the upper extension 5 of the bra cup 3*a*, 3*b*. As can be appreciated, because the upper extension 5 provides support to the user's breast by raising the breast and anchoring to the chest wall of the user, as described above, it is particularly important that the adhesive layer 10 of the upper extension 5 is protected from drying out and collecting debris. Therefore, it is preferred that the portion of the adhesive layer 10 of the upper extension 5 is protected using the backing layer 11 at least prior to first use of the bra cup 3*a*, 3*b*. However, it is understood that in other illustrative embodiments, the backing layer 11 may cover the entire adhesive layer 10, including the adhesive layer 10 of the cup portion 4 of the cup 3*a*, 3*b*.

As also shown, the outer periphery of the backing layer 11 is slightly larger than the outer periphery of the upper extension 5 so as to make the separation of the backing layer 11 from the upper extension 5 easier. In other embodiments, the backing layer 11 may be the same size and be continuous with the periphery of the upper extension 5. In addition, if the backing layer 11 is used to cover the entire area of the adhesive layer 10, the backing layer 11 may be either continuous with the outer periphery of the cup 3*a*, 3*b* or may extend beyond the periphery of the cup 3*a*, 3*b*. As can be appreciated, the backing layer 11 may be formed as two or more separated portions to assist the user in separating the backing layer 11 from the adhesive layer 10, and the portions of the backing layer 11 may overlap with one another to create flap portions which can be lifted by the user to initiate separation.

The backing layer 11 may be formed from a flexible material having a smooth surface. A suitable material might be coated paper such as, for example, 78 pound release Kraft liner. The backing layer 11 adheres to the surface formed by the adhesive layer 10, and the smooth surface of the backing layer 11 allows it to be peeled off to expose the adhesive layer 10 without removing the adhesive layer 10 from the support member 8.

FIG. 4 shows a cross-sectional view of the bra cup 3*a* shown in FIG. 3. As can be appreciated, the bra cup 3*b* has a similar cross-section. As shown in FIG. 4 and discussed above, the bra cup 3*a* includes the support member 8 which is formed from a plurality of layers, the adhesive layer 10 formed on the inside surface 9 of the support member and the backing layer 11 covering and adhering to a portion of the adhesive layer 10. In the illustrative case shown, the support member 8 includes a first layer 8*a* forming the front surface 6 of the bra cup 3*a*, 3*b*, a second layer 8*b* forming the inside surface 9 of the support member 8 and a third layer 8*c* disposed between the first layer 8*a* and the second layer 8*b*. The first and second layers 8*a*, 8*b* are formed from a thin film such as thermoplastic film such as, for example, polyurethane film, having a uniform thickness between 2 and 6 mils. The third layer 8*c* is formed from a gel or a foam material, or a combination thereof which is molded into the shape of the bra 1. An example of a suitable material to form the third layer 8*c* is silicone gel or a combination of silicone gel with a lower-density material. The material used for the third layer 8*c* also preferably has a texture that can provide a natural feel to the user's breast.

As shown in FIG. 4, the third layer 8*c* of the support member is enclosed by and sealed between the first and second layers 8*a*, 8*b* which form the front surface 6 and the support member inside surface 9, respectively. The first and second layers 8*a*, 8*b* are joined with the third layer 8*c* so as to prevent shifting of these layers with respect to one another. For example, the first and second layers 8*a*, 8*b* may be laminated to the opposing surfaces of the third layer 8*c* and, where the peripheries of the first and second layers extend beyond the periphery of the third layer 8*c*, the first and second layers may be joined to one another along the periphery of the third layer 8*c*.

The third layer 8*c* is molded so as to define the shape of the bra cup 3*a*, 3*b*. The thickness of the third layer 8*c* defines the thickness of each of the cups cup 3*a*, 3*b* and may be varied in accordance with the shape and the intended enhancement of the bra 1. For example, if a bra is intended to increase the user's cup size, the thickness of the third layer 8*c* will be made greater in the cup portion 4. In addition, the thickness of the third layer 8*c* decreases toward the outer periphery of the cup 3*a*, 3*b*, and the thickness of the third layer 8*c* in the cup portion 4 of the cup 3*a*, 3*b* is typically be greater than in the upper extension 5. Such variations in the thickness of the third layer 8*c* help minimize the visual appearance of the bra 1 when it is worn by the user.

As also shown in FIG. 4, the adhesive layer 10 is disposed on the entire inner surface 9 of the support member 8 formed by the second layer 8*b*. In particular, the adhesive layer can be grown on the inner surface 9 of the support member 8 using methods known in the art. The adhesive layer 10 can be a medical grade adhesive non-irritating to the user's skin for adhering the bra cups 3*a*, 3*b* to the user's skin. As mentioned above, the adhesive layer 10 is preferably a pressure-sensitive adhesive which can be re-used by the user after wearing the bra cups 3*a*, 3*b* and which can be cleaned using mild soap and water to remove any debris that may adhere to the adhesive layer 10. In FIG. 4, a portion of the adhesive layer 10 is covered by the backing layer 11 formed from a flexible material with a smooth surface. In the case shown, the backing layer 11 covers the adhesive layer of the upper extension 5.

The bra 1 shown in FIGS. 1-4 can be stored using a tray which is shaped to include two concave recesses adapted to house the first and second cups 3*a*, 3*b* of the bra 1. In particular, each cup 3*a*, 3*b* can be placed into the concave recess of the tray after being used and/or cleaned such that the outer surface 6 of the bra cup 3*a*, 3*b* abuts the concave surface of the tray and the inner surface 7 with the exposed adhesive layer 10 faces upwardly. The tray may also include a cover which can be placed over the tray so as to protect the adhesive layer 10 from debris while the bra 1 is being stored.

The bra 1 of FIGS. 1-4 can be manufactured using various processes. For example, the bra 1 may be manufactured using methods described in U.S. Pat. No. 5,693,164, which is incorporated herein by reference.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention, as defined by the accompanying claims. For example, additional layers may be used to form the support member of the bra cups so as to vary the appearance, shape or texture of the cups.

What is claimed is:

1. An adhesive bra cup element comprising:

a support member having an outer surface and an inner surface, and comprising at least one of a foam and a gel; and an adhesive layer disposed over at least a substantial area of said inner surface of said support member;

wherein said support member is formed as a concave cup portion for enclosing and supporting a breast of a wearer and an upper extension portion extending in an upward direction above said concave cup portion from an edge of an upper edge perimeter of said cup portion.

2. An adhesive bra cup element in accordance with claim 1, wherein said upper extension portion extends in an upward direction from at least a central area of said edge of said upper edge perimeter of the cup portion, said central area being centrally disposed along said upper edge perimeter of said cup portion between lateral edges of said cup portion.

3. An adhesive bra cup element in accordance with claim 2, wherein said upper extension portion is continuous and integrated with said cup portion.

4. An adhesive bra cup element in accordance with claim 3, wherein said upper extension portion extends from an uppermost edge of said upper edge perimeter of the cup portion.

5. An adhesive bra cup element in accordance with claim 4, wherein said upper extension has tapered sides and a rounded upper edge so as to give said bra element a teardrop shape.

6. An adhesive bra cup element in accordance with claim 2, wherein said support member comprises said gel, wherein said gel comprises silicone gel.

7. An adhesive bra cup element in accordance with claim 6, wherein support member comprises a plurality of layers, wherein a first layer and a second layer comprise thermoplastic film, and a third layer comprises molded silicone gel, said third layer being disposed between said first layer and said second layer.

8. An adhesive bra cup element in accordance with claim 7, wherein said first layer and said second layer are laminated to opposing surfaces of said third layer, said first layer forming said outer surface of said support member and said second layer forming said inner surface.

9. An adhesive bra cup element in accordance with claim 8, wherein said first and second layers comprise polyurethane film and said adhesive layer comprises pressure-sensitive re-usable adhesive.

10. An adhesive bra cup element in accordance with claim 9, wherein said adhesive layer is disposed over substantially the entire area of said inner surface of said support member.

11. An adhesive bra cup element in accordance with claim 10, wherein said bra element further comprises a backing layer affixed to at least a portion of said adhesive layer.

12. An adhesive bra cup element in accordance with claim 11, wherein said backing layer comprises coated paper.

13. An adhesive bra cup element in accordance with claim 12, wherein said backing layer is affixed to said adhesive layer of said upper extension.

14. An adhesive bra cup element in accordance with claim 8, wherein a thickness of said third layer is varied such that the thickness of said third layer in said cup portion decreases toward a periphery of said cup portion and the overall thickness of said third layer in said cup portion is greater than the thickness of said third layer in said upper extension portion of said bra element.

15. An adhesive bra cup element in accordance with claim 14, wherein the thickness of said third layer in said cup portion is increased so as to increase a user's bust size.

16. An adhesive bra cup element in accordance with claim 9, wherein said upper extension portion is continuous and integrated with said cup portion.

17. An adhesive bra cup element in accordance with claim 16, wherein said upper extension has tapered sides and a rounded upper edge so as to give said bra element a teardrop shape.

18. An adhesive support bra comprising:

a first adhesive bra cup element; and a second adhesive bra cup element;

wherein each of said first and second bra cup elements comprises a support member having an outer surface and an inner surface, and comprising at least one of a foam and a gel, and an adhesive layer disposed over at least a substantial area of said inner surface of said support member; and wherein said support member of each of said first and second bra cup elements is formed as a concave cup portion for enclosing and supporting a breast and an upper extension portion extending above said concave cup portion from an edge of an upper edge perimeter of said cup portion.

19. An adhesive bra in accordance with claim 18, wherein said upper extension portion extends in an upward direction from at least a central area of said edge of said upper edge perimeter of the cup portion, said central area being centrally disposed along said upper edge perimeter of said cup portion between lateral edges of said cup portion.

20. An adhesive bra in accordance with claim 19, wherein said upper extension portion is continuous and integrated with said cup portion.

21. An adhesive bra in accordance with claim 20, wherein said upper extension portion extends from an uppermost edge of said upper edge perimeter of the cup portion.

22. An adhesive bra in accordance with claim 20, wherein said support member comprises said gel, wherein said gel comprises silicone gel.

23. An adhesive bra in accordance with claim 22, wherein said support member comprises a plurality of layers, wherein a first layer and a second layer comprise thermoplastic film, and a third layer comprises molded silicone gel, said third layer being disposed between said first layer and said second layer, and said first layer and said second layer being laminated to opposing surfaces of said third layer such that said first layer forms said outer surface of said support member and said second layer forms said inner surface.

24. An adhesive bra in accordance with claim 23, wherein said first and second layers comprise polyurethane film and said adhesive layer comprises pressure-sensitive re-usable adhesive.

25. An adhesive bra in accordance with claim 24, wherein said adhesive layer is disposed over substantially the entire area of said inner surface of said support member.

26. An adhesive bra in accordance with claim 25, wherein each of said first and second bra cup elements further comprises a backing layer affixed to at least a portion of said adhesive layer.

27. An adhesive bra in accordance with claim 26, wherein said backing layer comprises coated paper.

28. An adhesive bra in accordance with claim 27, wherein said backing layer is affixed to said adhesive layer of said upper extension.

29. An adhesive bra in accordance with claim 27, wherein a thickness of said third layer is varied such that the thickness of said third layer in said cup portion decreases toward a periphery of said cup portion and the overall thickness of said third layer in said cup portion is greater than the thickness of said third layer in said upper extension portion.

30. An adhesive bra in accordance with claim 29, wherein the thickness of said third layer in said cup portion is increased so as to increase a user's bust size.

31. An adhesive bra in accordance with claim 19, wherein said upper extension portion extends from an uppermost edge of said upper edge perimeter of the cup portion and said upper extension has tapered sides and a rounded upper edge so as to give said bra element a teardrop shape.

32. An adhesive bra in accordance with claim 18, wherein said first cup element is not connected with said second cup element.

* * * * *